US005777598A

United States Patent [19]

Gowda et al.

[11] Patent Number: 5,777,598

[45] Date of Patent: Jul. 7, 1998

[54] COMPUTER-GENERATED DISPLAY PERMITTING ALIGNMENT OF ONE SCALE OF EACH OF A PLURALITY OF GRAPHS

[75] Inventors: Anil K. Gowda, Eden Prairie; Timothy J. McCarthy, Plymouth; Jeffrey C. Randall, Eden Prairie; George J. Tate, Edina, all of Minn.

[73] Assignee: Honeywell Inc., Minneapolis, Minn.

[21] Appl. No.: 774,478

[22] Filed: Dec. 30, 1996

[51] Int. Cl.[6] ..... G09G 5/36

[52] U.S. Cl. ..... 345/133; 345/134; 345/440

[58] Field of Search ..... 345/115, 133, 345/134, 140, 440; 600/483, 513, 523, 525

[56] References Cited

U.S. PATENT DOCUMENTS 5,199,103 3/1993 Smith et al. ..... 345/440

5,261,031 11/1993 Saito ..... 345/440

*Primary Examiner*—Matthew Luu

*Attorney, Agent, or Firm*—Edward L. Schwarz

[57] ABSTRACT

A computer system receives a number of different dependent variable data sets, all varying with respect to a single independent variable such as time, and displays a plot of each data set on a different one of a set of graphs, all of the graphs having conforming and preferably identical, aligned scales of the independent variable. The identical scales for the common independent variable are preferably in precise vertical alignment, which allows the viewer to more easily see relationships in the changes of the dependent variable data sets as the independent variable changes.

5 Claims, 3 Drawing Sheets

COMPUTER-GENERATED DISPLAY PERMITTING ALIGNMENT OF ONE SCALE OF EACH OF A PLURALITY OF GRAPHS

BACKGROUND OF THE INVENTION

Computers have become an important tool for displaying information of all kinds. Their ability to rapidly receive and format data, coupled with the speed of the CRT and liquid crystal display units typically used, allows communication of many types of physical process information to a viewer in real or near real time. Computers have the ability to organize both this real time information and other types of data as well in ways selectable by the viewer and which the viewer can easily and quickly understand.

One type of information which computers are frequently used for displaying in real time is that which can be displayed graphically. In a typical type of this display, the computer shows a time scale horizontally along an X axis at the graph's bottom. As real time data flows to the computer, it is processed and graphically displayed. The computer periodically (or continuously) shifts the time value at the scale origin point so as to keep the current time present on the screen along with recent historic values. A data value scale extends vertically along a Y axis from the origin point. Pairs of time and data values are entered on the graph to form a time-based plot of the data. The power of a typical computer makes it easy to change at the request of the user, the length of the time interval displayed on the time scale without changing the length of the scale itself, thereby allowing the amount of historical data displayed to be changed.

In many situations it is desired to show two or more parameters simultaneously on the same time scale. This allows the viewer to more easily understand the relationship between the changes within the various parameter values. The traditional method is to generate a single time scale, and then show a number of graph lines or other value indications in the space above the time scale. (For convenience, we will refer to graph lines hereafter to designate the form of parameter value display, but we include in this term other forms of time-related or time-based display such as bar graphs.) Where the graph displays different parameters, a vertical value scale for each parameter is placed along the left-hand edge of the graph. These value scales are spaced horizontally from each other to allow parameter values and dimensional labels to be juxtaposed. The lines or other indications of parameter value may be color-coded or have a distinctive pattern (different thicknesses, dotting, dashing, etc) so as to allow each to be distinguished from the others. The individual lines are then associated in some way, say by labeling or color coding, with their value scales.

There are some disadvantages with this type of display. Where there are a number of lines, the graph becomes cluttered and hard to view. Where a number of parameter values are displayed as bar graphs, they are not easy to align with the time scale. The value scales require horizontal space, thereby reducing the length of the time scale and the amount of historical information available. And it is difficult to combine some kinds of related information on a single scale. For example, two different scatter graphs would intermingle the recorded points, and even with shape or color coding be extremely difficult to analyze.

It is helpful to define the structure of the computers which will be used to practice this invention. Computers invariably use display units with screens such as screen 71 of FIG. 1 which are formed of a rectangular matrix of pixels (pi[x]

cture elements) to display information to a user. Each pixel is physically quite small. The resolution of typical display units now on the market ranges from 50 to 100 pixels per linear inch (two to four per mm.), providing quite a high quality picture. The pixels are referenced by their physical X and Y coordinates on the display screen. As shown in FIG. 1, it is conventional to assign the coordinates (0, 0) to the bottommost and leftmost pixel (reference pixel 81) on screen 71, and let the X and Y coordinate values increase to the right and upward respectively. Each pixel's individual appearance is controlled by the values in a portion (pixel byte) of a display memory assigned to that individual pixel. Each pixel is mapped by its coordinates to a specific pixel byte in the display memory. The computer during instruction execution sets the values in every pixel byte to cause display of any type of textual or graphical information desired. Video circuitry translates the video data in the display memory into the specified visual appearance of the individual pixels.

It is also useful to explain a number of terms pertaining to computer-generated graphs which will be used hereafter in discussing both the prior art and the invention. Referring to FIG. 1, three common rectilinear graphs are shown, each having a horizontal X axis and a vertical Y axis. Where time is a variable in a graph, it is conventional to display the graph with a horizontal time scale 100 (see the bottommost graph of FIG. 1) forming the X axis, where time increases from the left to right. This arrangement is simply illustrative, and it is possible for two variables other than time to be graphed, in which case a parameter other than time may be assigned to the X axis. It is also possible to assign time to the Y axis, but this is not standard practice, and will likely lead to confusion on the part of the viewer. A parameter value scale forming the Y axis 98 extends vertically at right angles to the X axis, typically intersecting the X axis at or near its left end. The leftmost point of the X axis time scale is conventionally called the X axis origin point, to which in the graphs of FIG. 1 is assigned time 11:05 AM. The rightmost point of the X axis time scale (11:07) is the X axis termination point. The point at which the Y axis 98 intersects the X axis is conventionally the origin point for both the X axis and the Y axis scales, although this certainly is not necessary. In the bottommost graph of FIG. 1 the origin of, the Y axis parameter carries the scale value of 0° C. The topmost scale mark, 1000° C., in the data value scale on the Y axis of the bottommost graph of FIG. 1 is its termination point. This assumption will be used hereafter. The term "origin point" will refer to both the X and Y axes origin points unless otherwise stated.

When such a graph is presented on a display unit, the origin point and the termination points of the X and Y axes are assigned individual pixels having coordinates defined as follows and shown in FIG. 1 with the hash marks indicating the locations of the point's X and Y pixel coordinates: ($Op_x$, $OP_y$)—X and Y axes origin point, hash marks 84 and 83 ($TP_x$, $OP_y$)—X axis termination point, hash marks 85 and 83 ($OP_x$, $TP_y$)—Y axis termination point, hash marks 84 and 86 In the bottom graph of FIG. 1, the length in pixels of the X axis is then $TP_x$—$OP_x$ and of the Y axis is $TP_y$—$OP_y$. The term "vertical alignment" or "vertically aligned" refers to pixels having the same X coordinate. The term "horizontal alignment" or "horizontally aligned" refers to pixels having the same Y coordinate.

Scale values are assigned to the X and Y axes origin points and termination points using the following notation:

$SV_{ox}$—X axis origin point scale value $SV_{tx}$—X axis termination point scale value $SV_{oy}$—Y axis origin point scale value $SV_{ty}$—Y axis termination point scale value For example, FIG. 1 shows three graphs, all of which have identical time scales on their X axes 92, 96 and 100. Looking at any of the graphs, the X axis scales 92, 96, 100 have time of day 11:05 AM=$SV_{ox}$ assigned to its origin point and 11:07 AM=$SV_{tx}$ assigned to its termination point. In the bottommost scale, 0° C.=$SV_{oy}$ is assigned to the Y axis origin point and 900° C.=$SV_{ty}$ of firing rate is assigned to its termination point.

For each of the axes it is possible to define a scale factor in terms of the number of pixels per unit value of the scale assigned to the axis: $SF_x$ for the X axis and $SF_y$ for the Y axis. The scale factor allows the pixel coordinates for a particular X axis scale value and a particular Y value scale value to be computed. $SF_x=(TP_x-OP_x)/(SV_{tx}-SV_{ox})$ [Equ. 1]and $SF_y=(TP_y-OP_y)/(SV_{ty}-SV_{oy})$ [Equ. 2]. Thus, for the bottommost graph of FIG. 1 again, if one assumes that the pixel coordinates for the X axis origin and termination points are respectively (100, 500) and (700, 500), then the X axis scale factor $SF_x=(700-100)/(11:07-11:05)=300$ pixel/min. One can compute the X axis pixel coordinate $PC_x$ for a particular scale value SV from the equation $PC_x=OP_x+(SV\times SF_x)$, and a similar computation is available for the Y axis scale.

We expect that this display system will be implemented in a personal computer having a CRT or liquid crystal display screen. It is helpful to briefly review the structure of a personal computer so as to understand that an implementation of a particular data processing system within a personal computer by an application program bears strong structural similarities to a hardware implementation of that same data processing system. Each of the functional elements which a hard-wired or other dedicated implementation requires has its exact physical analog in a computer-based software implementation. Registers, signals, logic and arithmetic elements, etc. all are present in a computerized software implementation. The computer, or parts of it, sequentially becomes first one and then another of these essential elements. Signals are provided to and from each of these elements by the simple expedient of storing in the memory in some way, the information content of each signal. Thus, the software when operating within a computer, conforms the computer to the hardware version in a way which corresponds almost exactly.

One should also note that even software has a physical existence. Within the computer, the effect of loading a program is to cause small but easily detectable physical changes in the computer memory. This new physical state of the computer's components is no less susceptible to treatment under the patent laws than is a device comprising larger discrete components easily visible to the unaided eye. There is no requirement in the patent laws that individual physical components of an invention have a minimum physical size or a particular physical format. No further notice will be taken of this equivalence between software and hardware implementations of an invention, but the invention will be described in terms of its physical elements to the extent possible. One should note that a person of skill in the programming arts can easily devise appropriate software to control the operation of a computer given the physical structure of a data processing system.

We should also mention that some of the invention's components formed within or from the computer are not known by any accepted English (or other) language term, nor are they available as a commercial product. For example, consider the software elements required to generate the pixel pattern displaying one of the X axes in FIG. 1. We can do no better than refer to such a collection of elements as an "X axis generator", although out of context this term has very little meaning. The reader should also understand that there are many different structures which can in fact serve these types of generalized functions. Where such terms are used in this description and also in the claims, we intend the term to cover any type of structure or collection of hardware and software elements which serves the stated function.

It is also helpful to briefly review features of the various windows-based operating systems now available for controlling the operation of personal computers. In these systems, it is possible to create individual rectangular sections, or windows, on the display screen. The computer can be further programmed to create an object of any kind, including a graph, in any of these windows. One can by using the computer mouse or other human-machine interface device, shift the location of each window to any desired position on the screen. FIG. 1 shows windows 80, 83, and 86 each containing one of the graphs. Bars 82, 88, and 87 form "handles" by which the entire window attached to a bar and its contents can be shifted vertically and horizontally by the use of a computer mouse. In one arrangement, locating the mouse arrow within the handle and then actuating a mouse button allows the user to move the entire window and its contents by its handle. In the present commercial embodiment the ability to move individual windows forms a part of the invention. We prefer to use computerized manipulation to properly position the individual windows with respect to each other.

One alternative type of display having a time base with a plurality of graph lines recording parameter values versus time is the so-called strip recorder, of which the polygraph and the electrocardiograph are examples. A strip recorder separates the individual graph lines along and typically on each side of a pre-printed time scale on a paper strip or tape. Pens or other line-generating devices trace individual parameter values, and the paper strip on which the graph lines are recorded also bears longitudinal lines indicating values for the parameters traced. These are special purpose devices intended to display predetermined parameters for a particular purpose. For the most part, while the graphs are generated in real time, there is no need for them to be available in real time. The analyst for such a set of graphs usually needs and has time to digest the information generated by a strip recorder.

BRIEF DESCRIPTION OF THE INVENTION

I have developed an alternative display system which allows a number of different graphs to be simultaneously displayed on a single screen in a manner which allows the viewer to easily correlate with every other graph, the information presented in each. Such a display system simultaneously visually displays on a screen having a rectangular pixel matrix, first through Nth graphs having conformed and vertically aligned X axis scales indicating a range of values of an independent variable. We use the term "conformed" here to mean that the scales each have identical scale factors and origin points. Adjacent to each X axis scale in each graph is a plot displaying the respective one of first through Nth distinct dependent variable data sets encoded in first through Nth data signals respectively. Each data set comprises a plurality of data values, and each data value in each data set corresponds to a value indicated in the X axis scale.

The display system comprises a first register for recording an X axis scale factor, and for providing a scale factor signal encoding the recorded scale factor value. There is a second register for recording an X axis origin point scale value from the independent variable value range, and corresponding to a value in each of the dependent variable data sets, and providing a scale value signal encoding the recorded scale value. A third register records an origin point pixel X coordinate value and provides an origin point X coordinate signal encoding the recorded origin point pixel X coordinate value.

There are first through Nth Y coordinate registers associated respectively with the first through Nth data sets, each for recording for the associated one of the first through Nth data sets, a Y axis pixel coordinate. Each of said Y axis pixel coordinates recorded by the one through Nth Y coordinate registers is different from every other Y axis pixel coordinate, and each Y coordinate register provides one of first through Nth Y pixel signals encoding the coordinate value recorded by that Y coordinate register.

There is a display memory having a plurality of pixel bytes each assigned to a pixel in the pixel matrix, and recording display data values in the pixel bytes responsive to first through Nth graph signals, said display memory providing a display signal encoding the recorded display data values. A display unit receiving the display signal and includes the screen having rectangular pixel matrix. The display unit provides a visual indication based on the display signal. Each pixel in the matrix is associated with a particular pixel byte of the display memory. Each pixel provides a visual indication dependent on the display data value recorded in the associated display memory pixel byte.

There are first through Nth graph generators associated respectively with the first through Nth data signals and the first through Nth Y pixel signals. Each graph generator receives the scale factor signal, the scale value signal, the origin point X coordinate signal, the associated one of the first through Nth Y pixel signals, and the associated one of the first through Nth data signals. Each said graph generator provides a graph signal from which the data memory records values in pixel bytes, from which the display unit generates an X axis scale having the scale factor encoded in the scale factor signal, the origin point scale value encoded in the scale value signal, the origin point pixel X coordinate value encoded in the origin point X coordinate signal, and the Y coordinate value encoded in the associated one of the first through Nth Y pixel signals. Each graph generator further provides a graph signal from which the data memory records values in pixel bytes from which the display unit generates a data plot representing the data encoded in the one of the first through Nth data signals with which is associated the graph generator. The data plot Y pixel coordinates are computed relative to the Y axis pixel coordinate value encoded in the one of the Y pixel signals received by the graph generator.

This display system generates X axis scales and associated data plots which make it easy for the human user to identify and compare data trends between seemingly disparate data sets.

DESCRIPTION OF THE PREFERRED EMBODIMENTS

Figure 1:
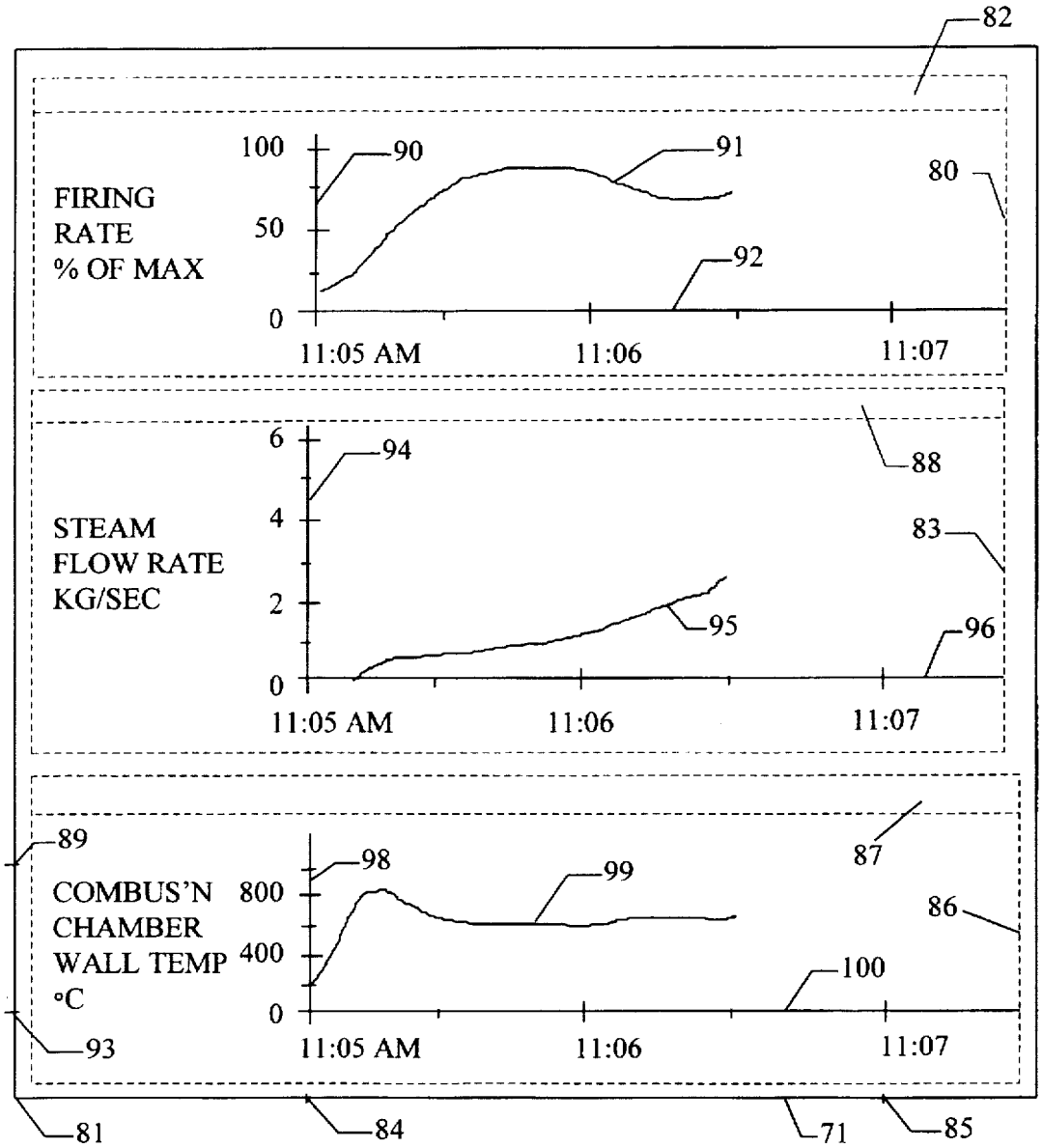
FIG. 1 is an arrangement of three graphs according to the invention.

FIG. 1 displays three graphs generated by this invention and whose format is a result of practicing this invention. Although the information displayed in all three graphs pertains to operation of a theoretical boiler as can be inferred from the labels of the graphs, the invention can be used to display the operation of a wide variety of systems. The graph having axes 90 and 92 displays a plot 91 of firing rate of the boiler as a percent of maximum. The graph having axes 94 and 96 displays a plot 95 of steam mass flow rate in kgs./sec. The graph having axes 98 and 100 displays a plot 99 of the temperature of the combustion chamber wall at a preselected point. We will frequently refer to the graphs of FIG. 1 for examples of the graphs formed by the elements of FIGS. 2 and 3.

To display the more convenient features of this invention, the X axes of the three graphs all have as their scale values, time as an independent variable. It is not essential that each graph share time as the common variable, but time is the most likely candidate as the common variable. The plots of data shown in FIG. 1 simulate a real time display in which the data plots extend from 11:05 AM to 11:06:30. By inference, the current time in this set of graphs is 11:06:30 or shortly thereafter, since there evidently was an update for all three plots at 11:06:30 or shortly thereafter. The invention lies in the positioning and format of these graphs' X axes. These graphs all have an identical X axis scale factor. That means that the number of pixels between two identical time values in each scale is identical. Further, each graph has its origin point in vertical alignment with every other graph's origin point. This condition places each time value in each X axis time scale in vertical alignment with the same time value in every other X axis time scale. This identical format and vertical alignment for each of the X axis scales makes it much easier for the viewer to grasp the time-based relationship among the plots on each graph. For example, the plots of FIG. 1 allow the user to see first of all the combustion chamber wall temperature to steeply rise as firing rate increases. Shortly thereafter, steam starts flowing, with its mass flow rate increasing as firing rate and combustion chamber wall temperature stabilize. All of this can be quickly determined without the need to sort out among a number of plots on a single graph. We have found this arrangement of graphical information to have substantial user appeal. The Y axes will of course represent different scale values as shown, and these can extend over different number of pixels and have different scale values. Each X axis is identical to each of the other X axes except for the differing Y coordinates. In general, we prefer the graphs to be spaced such that the individual graphs do not overlap or overlay each other.

Figure 2:
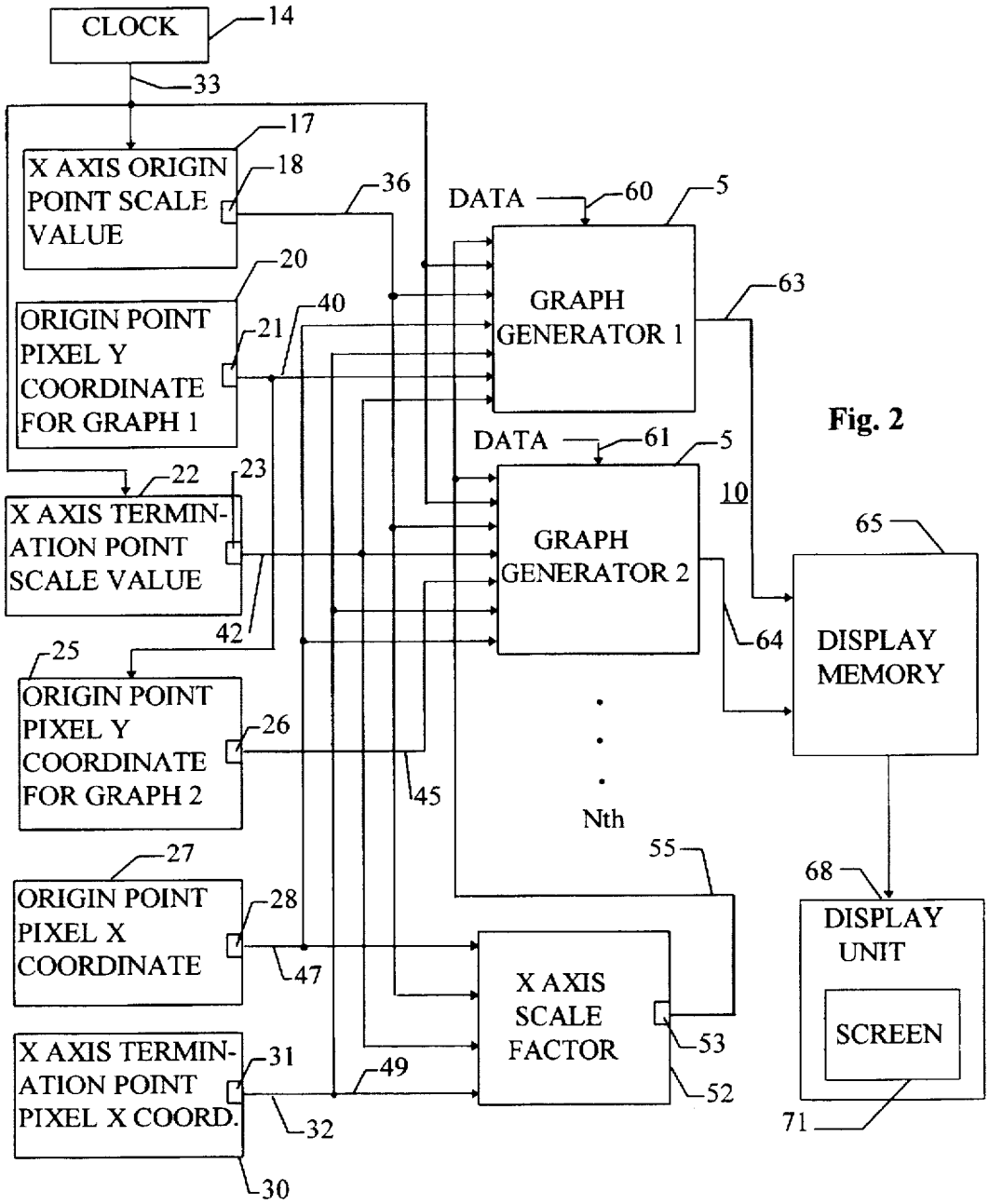
FIG. 2 is a block diagram of the elements of the invention.

The block diagram shown in FIG. 2 depicts the hardware structure of a preferred embodiment for the invention. As mentioned, we contemplate that this invention will be implemented within a computer such as a personal computer. Some of the elements of FIG. 1 (and FIG. 2) will comprise components of the computer, and others come into being briefly as parts of the software which implements the invention are executed by the computer. Their existence as hardware is typically fleeting, but nonetheless sufficient to fulfil the function.

FIG. 2 shows a computer 10 which conventionally includes a display memory 65 and a display unit 68 having the screen 71 of FIG. 1 as a part of it. As previously explained, there is a pixel byte within display memory 65 assigned to each pixel comprising screen 71 which controls the visual characteristics of that pixel. By recording suitable data in the individual pixel bytes of display memory 65, the patterns of the individual graphs may be formed on screen 71. Data is changed in the individual bytes of display memory 65 by data transfers within computer 10. These data transfers are represented in FIG. 2 by the graph signals 63, 64, etc.

Computer 10 further includes first through Nth graph generators 58, 59, etc. each associated with a single one of the graphs appearing on the video screen 71. For convenience, associate the topmost graph of FIG. 1 with graph generator 1 and the middle graph with graph generator 2. To avoid excessive clutter in FIG. 2, there is no graph generator shown for the bottommost graph of FIG. 1. Each of the graph generators 58, 59, etc. actually generates for its associated graph, the video data defining the visual characteristics of the individual pixels which form the X and Y axes scales, the associated text, and the data plot in each of the individual graphs, and encodes the video data in a graph signal provided on paths 63, 64, etc. respectively, to display memory 65. The information in each graph signal updates display memory 65 sufficiently to completely define all of the visual characteristics of the associated graph at that instant. The individual graph generators 58, 59, etc. are hardware elements into which computer 10 is transformed by executing appropriate software. Typically, much of the software and hardware which creates each of the graph generators 58, 59, etc. is actually the same, and the various parameters defining the various individual graphs are changed from execution to execution.

Graph generators 58, 59, etc. each receive a number of format data signals from which the graph signals are derived. These format data signals encode information which is provided by a human user in defining the characteristics of the individual graphs. This information may be provided by a computer mouse, by the keyboard, or both. A portion of the computer 10 software which implements this invention provides the user interface allowing the user to provide the information encoded in the format data signals. There are a number of formatting modules which accept and modify the information allowing graph generators 58, 59, etc. to form the X and Y axes scales of the graphs and to place them properly in the pixel matrix of screen 71. Each of the formatting modules include an output register in which is recorded the current data in the format data signal issued by that formatting module.

The graphs shown in FIG. 1 have the conventional format where the X axis of each graph is positioned below its associated Y axis, and the intersection of the X and Y axes defines the origin point of each axis. FIG. 2 shows only the formatting modules for creating the X axis, as it is the existence and relative positions of these X axes which distinguishes the invention. Each of the formatting modules includes a register or memory cell of the same name in which is recorded the current value of the associated formatting data. For example, module 17 has an X axis origin point scale value register 18 in which module 17 records the X axis origin point scale value. It is most convenient to first briefly explain in the following Formatting Modules Definition table, the various formatting modules which create the X axes for the graphs.

| Module Name | Module Ref. No. | Output Reg./Data Path Ref. Nos. | Purpose |
|---|---|---|---|
| X Axis Origin Point Scale Value | 17 | 18/36 | Specifies scale value assigned to left-hand end of X axis |

-continued

| Module Name | Module Ref. No. | Output Reg./Data Path Ref. Nos. | Purpose |
|---|---|---|---|
| Origin Point Pixel Y Coordinate for Graph 1 | 20 | 21/40 | Specifies pixel Y coordinate for origin point of graph 1's X axis |
| X Axis Termination Point Scale Value | 22 | 23/42 | Specifies scale value assigned to right-hand end of X axis |
| Origin Point Pixel Y Coordinate for Graph 2 | 25 | 26/45 | Specifies pixel Y coordinate for origin point of graph 2's X axis |
| Origin Point Pixel X Coordinate | 27 | 28/47 | Specifies pixel x coordinate for origin point of each graph's x |
| X Axis Termination Point Pixel X Coordinate | 30 | 31/49 | Specifies pixel x coordinate for termination point of each graph's X axis |

Figure 3:
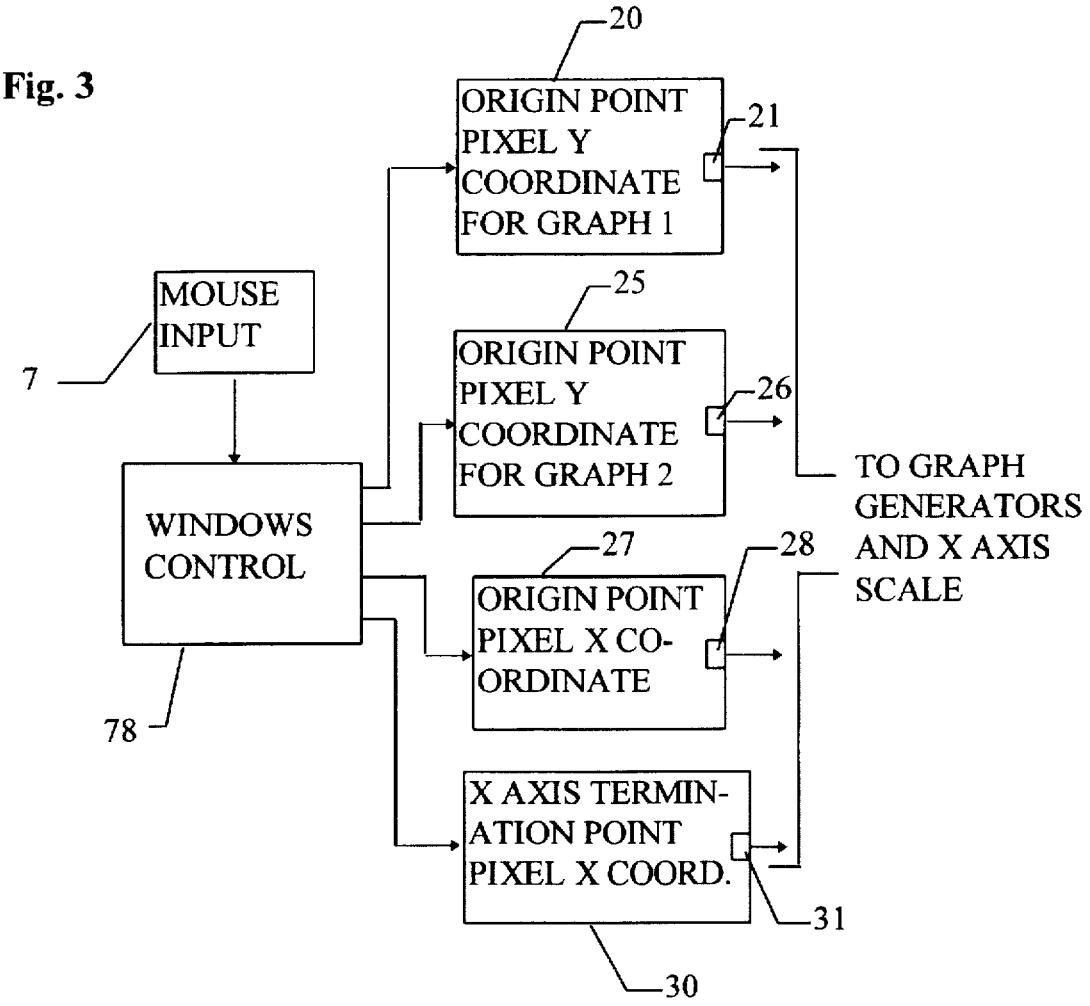
FIG. 3 is a block diagram of elements of the invention which select the position of the graphs.

In the preferred embodiment of FIG. 2, module 27 provides the X axis pixel coordinate value to the graph generators 58, 59, etc. This automatically places the origin points and Y axes of the graphs in vertical alignment. However, in our present commercial embodiment, we rely on the human user to align the individual graphs by shifting the associated windows horizontally until the X axes of the graphs in each are in vertical alignment. In FIG. 3 this is symbolized by a mouse input which can be used to provide inputs to the conventional windows control software module 78.

So long as the X coordinates of the X axis scales' origin points, the origin point scale values, and the graphs' X axis scale factors are identical, and the Y coordinates of each of the graphs' X axis scales are sufficiently different, it is easy for the viewer to visually discern relationships between changes along the X axes in any pair of graphs' plots. While it is desirable for the termination points 85, etc. of the graphs' X axes to also be in alignment, this is not essential. Our invention generally includes systems displaying a plurality of graphs each having its own X axis and Y axis. In these systems, the X axes' origin points all have assigned to them the identical scale value and the X axes' origin points are all in vertical alignment. Further, the graphs' X axes all have identical scale factors, and the graphs and their X axes are all spaced vertically from each other to prevent any of the plots and the X and Y axis scales from overlaying each other, to thereby allow the viewer to clearly view each of the graphs in aligned juxtaposition to each other. We refer to X axes displaying such a relationship as being conformed to each other.

The mouse input and windows control 78 of FIG. 3 can also provide inputs for selecting the pixel coordinates for the origin and termination points of the X and Y axes scales. This may be done by the well-known "drag and drop" technique, or by simply selecting dialog boxes using the mouse by which numeric values may be entered from the keyboard.

One can see in FIG. 2 that the formatting data signal provided by module 20 on path 40 is provided as an input to module 25. Module 25 provides the formatting data signal which determines the vertical position of graph 2 on screen 71. It is important that the individual graphs not overlap, and this input to module 25 assists module 25 in automatically positioning graph 2 to prevent this overlap. Of course, other formatting data, such as the height of the vertical scales of adjacent graphs is also required by module 25 to automatically prevent overlapping of graphs.

A conventional internal clock 14 provides a clock signal on path 33 to graph generators 58, 59, etc. and to formatting modules 17 and 22. The clock signal encodes the current time and date allowing the graph generators 58, 59, etc. to provide the proper legends for the X axis and modules 17 and 20 to select suitable origin and termination point scale values as time advances. The internal clock 14 is a part of the computer 10 hardware, and is initially set and thereafter updates itself automatically. With these values, graph generators 58, 59, etc. can be easily designed by those with skill in the art to display X axes having the common positional relationships and formats shown in FIG. 1. Data supplied typically from a source outside of computer 10, but stored for some period of time within computer 10 is shown as supplied to graph generators 58, 59, etc. on data paths 60, 61, etc. and is used to develop the dependent variable data plots shown in the graphs of FIG. 1. The formulas provided earlier allow the actual Y pixel coordinate corresponding to each of the data values at a particular time to be calculated. The display memory 65 is updated with the appropriate data in the associated pixel byte to permit the actual data plot in each of the graphs to be displayed.

The X axis scale factor module 52 receives the formatting data signals from modules 17, 22, 27, and 30 to calculate the scale factor for the X axes using Equ. 1 set out above, and record the scale factor in register 53. Graph generators 58, 59, etc. use the scale factor from register 53 encoded in the scale factor signal on path 55 along with the current clock signal value on data path 33 to determine the X pixel coordinate of a currently received data value on path 60 or 61. Using Equ. 2 allows the Y pixel coordinate for the to be calculated for each graph by a similar Y axis scale factor module. Of course, the Y axis scale factor will typically be different for each graph, and will have to be separately calculated.

The formatting modules 17 and 22 also receive the clock signal, allowing the X axis origin and termination point scale values to be periodically updated, so as to allow the current Y axis scale values along with a suitable amount of historical data in each scale to be simultaneously displayed.

With an understanding of this structure, one of ordinary skill will be able to devise a system within her computer which aligns a series of graphs sharing a similar time or other parameter scale to permit easy comparison of the plotted variations in the dependent variable.

We claim:

1. A display system for simultaneously visually displaying on a screen having a rectangular pixel matrix, first through Nth graphs having conformed and vertically aligned X axis scales indicating a range of values of an independent variable and a plot in each graph displaying the respective one of first through Nth distinct dependent variable data sets encoded in first through Nth data signals respectively, each data set comprising a plurality of data values, each data value in each data set corresponding to a value indicated in the X axis scale, said display system comprising:

a) a first register for recording an X axis scale factor, and providing a scale factor signal encoding the recorded scale factor value;

b) a second register for recording an X axis origin point scale value from the independent variable value range, and corresponding to a value in each of the dependent variable data sets, and providing a scale value signal encoding the recorded scale value;

c) a third register for recording an origin point pixel X coordinate value and providing an origin point X coordinate signal encoding the recorded origin point pixel X coordinate value;

d) first through Nth Y coordinate registers associated respectively with the first through Nth data sets, each for recording for the associated one of the first through Nth data sets, a Y axis pixel coordinate, each of said Y axis pixel coordinates recorded by the one through Nth Y coordinate registers different from every other Y axis pixel coordinate, and each Y coordinate register providing one of first through Nth Y pixel signals encoding the coordinate value recorded by that Y coordinate register;

e) a display memory having a plurality of pixel bytes each assigned to a pixel in the pixel matrix, and recording display data values in the pixel bytes responsive to first through Nth graph signals, said display memory providing a display signal encoding the recorded display data values;

f) a display unit receiving the display signal and including the screen having rectangular pixel matrix for providing a visual indication based on the display signal, each pixel in the matrix in association with a particular pixel byte of the display memory, and each pixel providing a visual indication dependent on the display data value recorded in the associated display memory pixel byte; and g) first through Nth graph generators associated respectively with the first through Nth data signals and the first through Nth Y pixel signals, each graph generator receiving the scale factor signal, the scale value signal, the origin point X coordinate signal, the associated one of the first through Nth Y pixel signals, and the associated one of the first through Nth data signals, each said graph generator providing a graph signal from which the data memory records values in pixel bytes, from which the display unit generates an X axis scale having the scale factor encoded in the scale factor signal, the origin point scale value encoded in the scale value signal, the origin point pixel X coordinate value encoded in the origin point X coordinate signal, and the Y coordinate value encoded in the associated one of the first through Nth Y pixel signals, and each graph generator further providing a graph signal from which the data memory records values in pixel bytes from which the display unit generates a data plot representing the data encoded in the one of the first through Nth data signals with which is associated each said graph generator, each of said data plot Y pixel coordinates being relative to the Y axis pixel coordinate value encoded in the one of the Y pixel signals received by each said graph generator.

2. The display system of claim 1 further comprising a fourth register for recording a termination point pixel X coordinate value and providing a termination point X coordinate signal encoding the recorded termination point pixel X coordinate value, wherein each graph generator receives the value recorded in the termination point X coordinate signal, and each graph generator provide a graph signal from which the data memory records values in pixel bytes from which the display unit generates an X axis scale having the termination point pixel X coordinate encoded in the termination point X coordinate signal.

3. The display system of claim 2, wherein at least two graph generators each provide a graph signal from which the data memory records values in pixel bytes from which the display unit generates for each of at least two X axis scales, a line comprising a plurality of visually distinctive pixels all having the Y pixel coordinate received by the graph generator, and wherein at least two graph generators each provide a graph signal from which the data memory records values in pixel bytes from which the display unit generates an X axis scale comprising a plurality of contrasting pixels having the identical Y axis pixel coordinate, in which the origin point pixel X coordinate value is smaller than every other one of the X coordinate values comprising the X axis scale.

4. The display system of claim 3, further comprising a graph parameter controller accepting from a human user, manual inputs specifying an origin point pixel X coordinate value and a termination point pixel X coordinate value, and loading said origin and termination coordinate values into the third and fourth registers respectively.

5. The display system of claim 4, wherein the graph parameter controller further includes a Y position controller accepting from a human user at least first and second manual inputs specifying at least two different origin point pixel Y coordinate values and loading said at least first and second origin point Y coordinate values respectively into the at least first and second Y coordinate registers.

* * * * *

UNITED STATES PATENT AND TRADEMARK OFFICE

CERTIFICATE OF CORRECTION

PATENT NO. : 5,777,598
DATED : July 7, 1998
INVENTOR(S) : Anil K. Gowda, et al

It is certified that error appears in the above-identified patent and that said Letters Patent is hereby corrected as shown below:

On the title page, item [75] Inventors: Delete "Timothy J. McCarthy" and insert -- Timothy F. McCarthy --.

Column 2, line 30, delete "may" and insert -- will --.

Signed and Sealed this
Fifth Day of January, 1999

*Attest:*

*Attesting Officer*

*Acting Commissioner of Patents and Trademarks*